US006997355B2

(12) United States Patent
Duquet et al.

(10) Patent No.: US 6,997,355 B2
(45) Date of Patent: Feb. 14, 2006

(54) FLUID PRODUCT DISPENSER

(75) Inventors: Frédéric Duquet, Thibouville (FR); Hervé Pennaneac'h, Verneuil sur Avre (FR)

(73) Assignee: Volois S.A.S., Le Neubourg (FR)

( * ) Notice: Subject to any disclaimer, the term of this patent is extended or adjusted under 35 U.S.C. 154(b) by 163 days.

(21) Appl. No.: 10/293,272

(22) Filed: Nov. 14, 2002

(65) Prior Publication Data

US 2003/0094466 A1 May 22, 2003

Related U.S. Application Data

(60) Provisional application No. 60/342,365, filed on Dec. 27, 2001.

(30) Foreign Application Priority Data

Nov. 14, 2001 (FR) ..... 01 14723

(51) Int. Cl.
*B65D 37/00* (2006.01)

(52) U.S. Cl. ..... 222/209; 222/212; 222/541.6; 222/633

(58) Field of Classification Search ..... 222/209, 222/212, 541.6, 632, 633; 239/327, 328

See application file for complete search history.

(56) References Cited

U.S. PATENT DOCUMENTS

| | | | | |
|---|---|---|---|---|
| 553,765 | A * | 1/1896 | Ruppolt | 239/327 |
| 2,091,081 | A * | 8/1937 | Sharpe | 222/633 |
| 2,432,288 | A | 12/1947 | Danziger | |
| 2,788,921 | A | 4/1957 | Galinas | |
| 3,687,358 | A * | 8/1972 | Wink et al. | 383/208 |
| 3,897,005 | A | 7/1975 | Reiner | |
| 3,986,640 | A * | 10/1976 | Redmond | 222/92 |
| 4,096,948 | A * | 6/1978 | Kuchenbecker | 229/104 |
| 4,858,831 | A * | 8/1989 | Spector | 239/326 |
| 5,348,194 | A * | 9/1994 | Mascitelli et al. | 222/209 |
| 6,357,631 | B1 * | 3/2002 | Zaksenberg | 222/212 |

FOREIGN PATENT DOCUMENTS

| | | |
|---|---|---|
| FR | 2 791 645 A | 10/2000 |
| FR | 2 813 364 A | 3/2002 |
| GB | 626 631 A | 7/1949 |

* cited by examiner

*Primary Examiner*—Joseph A. Kaufman
(74) *Attorney, Agent, or Firm*—Sughrue Mion, PLLC

(57) ABSTRACT

A fluid product dispenser having a reservoir of fluid product defining a moveable actuating wall, a distribution orifice, and a spring structured to act on the actuating wall to produce a state of maximum volume of the reservoir. The spring co-operates with an arming element structured to cause the spring from an initial state in which the spring does not bias the actuating wall to a state in which the spring biases the actuating wall.

20 Claims, 6 Drawing Sheets

FLUID PRODUCT DISPENSER

CROSS REFERENCE TO RELATED APPLICATION

This application claims the benefit under 35 U.S.C. §119 (e) of pending U.S. provisional patent application Ser. No. 60/342,365, filed Dec. 27, 2001, and priority under 35 U.S.C. §119(a)–(d) of French patent application No. FR-01.14723, filed Nov. 14, 2001.

TECHNICAL FIELD

The present invention relates to a fluid product dispenser comprising a reservoir of fluid product defining a movable or deformable actuating wall able to be pushed in, a distribution orifice and spring means adapted to act on the actuating wall to reach a state with maximum volume of the reservoir. The dispenser, or at least the reservoir, for example, can be made out of one or two flexible sheets forming the actuating wall. By pushing in the actuating wall against the spring means, the internal volume of the reservoir is reduced and the fluid product is thus expelled through the distribution orifice. This is a classic design for the perfumery, cosmetics, or pharmaceutical domains.

The spring means bias the actuating wall, deforming it to a state of maximum deformation in which it defines a state of maximum volume for the reservoir. The deformation of the deformable wall is not always aesthetic, because of the spring means, and thus can spoil the appearance of the dispenser. In addition, the spring means increase the total thickness of the dispenser which can be a major inconvenience for use in certain cases.

BACKGROUND OF THE INVENTION

In fact, a dispenser of this type is known from document FR-2 791 645, whose orifice is blocked before utilisation by a removable seal. The interior of the reservoir thus does not communicate with the exterior and, according to this document, the spring which acts on an deformable wall is compressed to a maximum state, such that the thickness of the dispenser can be maintained at a minimum. This is a primordial requirement when one wishes to include such a dispenser in magazines under the form of a fluid product sample. Even when the distribution orifice is sealed, the spring evidently acts on the deformable wall, which deforms the deformable wall anaesthetically which has an outline that is often irregular.

Other prior art dispensers with a non deformable, but just movable, actuating wall, are also known.

SUMMARY OF THE INVENTION

The aim of the present invention is to overcome this inconvenience of prior art by defining a dispenser of fluid product whose spring means do not lower the aesthetics of the deformable actuating wall, at least before utilisation of the dispenser.

In order to achieve this aim, the present invention provides a fluid product dispenser comprising a reservoir of fluid product defining a actuating wall able to be moved, a distribution orifice, and spring means adapted to bias the actuating wall to produce a state of maximum volume of the reservoir, characterised in that the spring means co-operate with the arming means able to bring the spring means to bias the actuating wall starting from an initial state in which the spring means do not bias or act on the actuating wall. Thus, the spring means do not act on the actuating wall in the initial state and one does not use arming means to confer the spring means with their real and desired function, that is to say to bias or act on the actuating wall. The dispenser according to the invention can consequently be stored before utilisation in a state in which the spring means do not act on the actuating wall. In the absence of stress, the actuating wall remains without constraint and can thus keep a suitably aesthetic appearance.

The aim of the invention resides in the fact that the spring means do not fulfil their function until the moment desired, in this case just before utilisation of the dispenser. The actuating wall, and thus the dispenser, can then remain in a perfectly flat state, able to be used as a sample in magazines.

According to one embodiment, the arming means are located outside the reservoir. The arming means can for example comprise a pivoting action organ. However one can imagine a rotating or translational action.

Advantageously, the spring means and the arming means are made in a mono-block way.

According to another embodiment of the invention, the spring means extend into the reservoir under the actuating wall. As a variant, the spring means are integrated into the actuating wall.

In another embodiment of the invention, the spring means and the arming means are connected by a deformable zone. Advantageously, the deformable zone is able to form a folding or pivoting line.

According to another embodiment of the invention, the spring means and the arming means comprise a substantially rigid flexible element defining an internal part which extends to the interior of the reservoir and an external part which extends to the exterior of the reservoir, the internal part forming the spring means and the external part forming the arming means.

According to a practical embodiment, the reservoir comprises two sheets, one of which defines the deformable actuating wall, the substantially rigid flexible element extending between the two sheets. Advantageously, a substantially rigid substrate is interposed between the two sheets, said substrate forming the substantially rigid flexible element.

According to an embodiment the substrate comprises a reservoir part forming a recess which defines, with the two sheets, said reservoir for the fluid product. Advantageously, the substrate further comprises an actuating part connected to the reservoir part along the fold line. Preferably, the reservoir part and the actuating part have substantially identical dimensions, such that they can be superposed after folding along the fold line. Advantageously, the internal part of the foldable element of the substrate extends along the same plane as the reservoir part, before folding the actuating part of the substrate forming the external part of the flexible element.

According to another characteristic of the invention, already presented in the document FR 2 791 645, the distribution orifice is sealed by a removable sealing organ. Advantageously, the reservoir contains almost only fluid product before the removable sealing organ is withdrawn. Before withdrawing the removable sealing organ, or more generally before utilisation of the dispenser, one can activate the arming means so as to activate the spring means to stress the actuating wall. Before actuating the arming means, the spring means are inoperative on the deformable actuating wall.

According to another embodiment, the arming means are located in the reservoir. The spring means can for example be in the form of a blade spring incorporating arming means which only become operative after the spring's first expansion.

According to another embodiment, the spring means comprise a flexible front plate and a rear plate, the reservoir being situated between the front and back plates, the arming means comprising spacer means able to be positioned between the front plate and the rear plate to separate them from each other, at least locally, the flexible front plate thus being elastically deformable when the rear plate approaches so as to squash the reservoir between them.

Advantageously, the spacer means are movable selectively between an inoperative position in which the two plates extend substantially parallel corresponding to a minimum volume state of the reservoir and an operative position in which the two plates are separated from each other. Advantageously, the spacer means comprise an articulated flap integral with the front plate or back plate respectively at the level of an articulation line and defining a bearing edge intended to come into bearing contact against the rear or front plate respectively, said flap being substantially non-deformable. Advantageously, the dispensing orifice is closed by a removable sealing organ (6), common actuating means (62) being provided for consecutively removing the removable sealing organ and positioning the spacer means between the two plates.

Alternatively, the reservoir being located between the front and rear plates, the arming means comprising spacer means which can be positioned between the front plate and the rear plate, to separate them from each other, at least locally, the spacer means being elastically deformable so as to allow the front and rear plates to approach each other and thus squash the reservoir located between them.

BRIEF DESCRIPTION OF THE DRAWINGS

The invention will now be described in more detail with reference to the attached drawings given as a non-limiting example of an embodiment of a dispenser according to the invention.

In the figures.

DETAILED DESCRIPPTION OF THE PREFERRED EMBODIMENT

Figure 1:
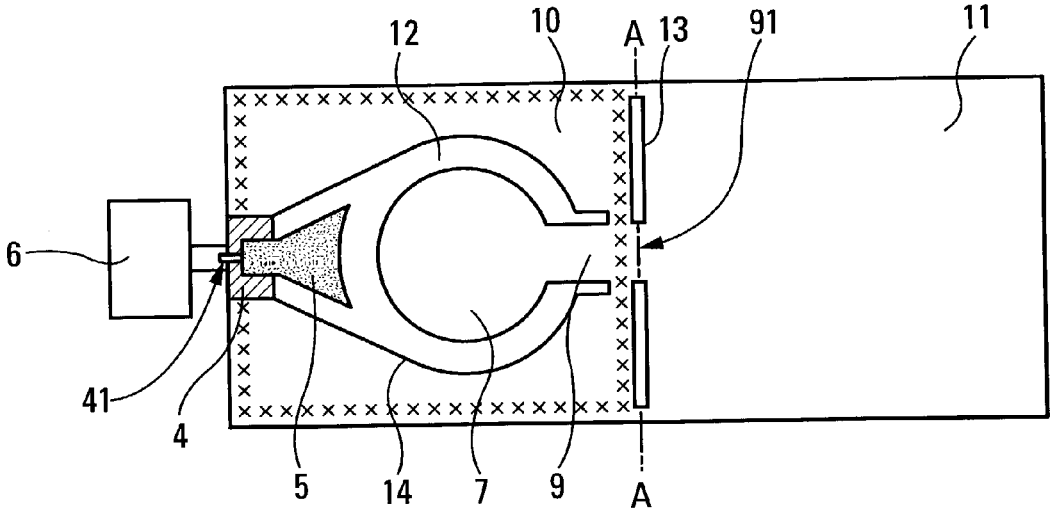
FIG. 1 is a view from above of a dispenser according to the invention, in which a constitutive sheet has been removed.

In the embodiment of FIGS. 1 to 5, the fluid product dispenser comprises a plate or substrate 1 with, for example, a thickness of the order of 1 to 2 mm and also having a certain rigidity. For example, one can use a plate made out of an appropriate plastic material. Apart from the substrate 1, the dispenser also comprises two sheets 2 and 3 arranged on each side of the substrate 1. At least one of the two sheets, in this case sheet 2, is flexible or deformable. The other sheet 3 can also be flexible or deformable. However, one can also imagine a sheet 3 which is perfectly rigid or even incorporated into the substrate 1. In fact, it is not excluded that the substrate 1 may define a base such as the shape of sheet 3.

Substrate 1 also forms a distribution orifice. More precisely, the substrate 1 can comprise or form a housing in which a support part 4 is received, which defines the distribution orifice 41. This support part 4 further serves to maintain fixed a part of porous material 5 able to absorb fluid product by capillarity. Evidently, this is only a special embodiment, and one can well imagine design variants in which the distribution orifice is formed directly by the substrate or even at the level of one of the two sheets 2 and 3. In other terms, the precise positioning of the distribution orifice is not a critical characteristic for the present invention.

According to the invention, the distribution orifice 41 is sealed before using the dispenser by a removable sealing organ 6 which can be presented under the form of a smooth tab. In order to free the distribution orifice 41, it suffices to pull the tab 6 so as to break it away from the substrate 1. Here again, other shapes can be thought of for the removable seal.

According to the invention, the substrate 1 forms a reservoir part 10 and an actuating part 11 connected together at a fold line AA produced at the level of the substrate 1 under the form of two windows 13 which extend along the axis of the fold line AA. These two elongated windows 13 make a line of weakness crossing the substrate 1 such that the substrate 1 has a tendency to fold in two along the fold line AA if one pushes or pulls on the actuating part 11 while maintaining the reservoir part 10 fixed.

Figure 2:
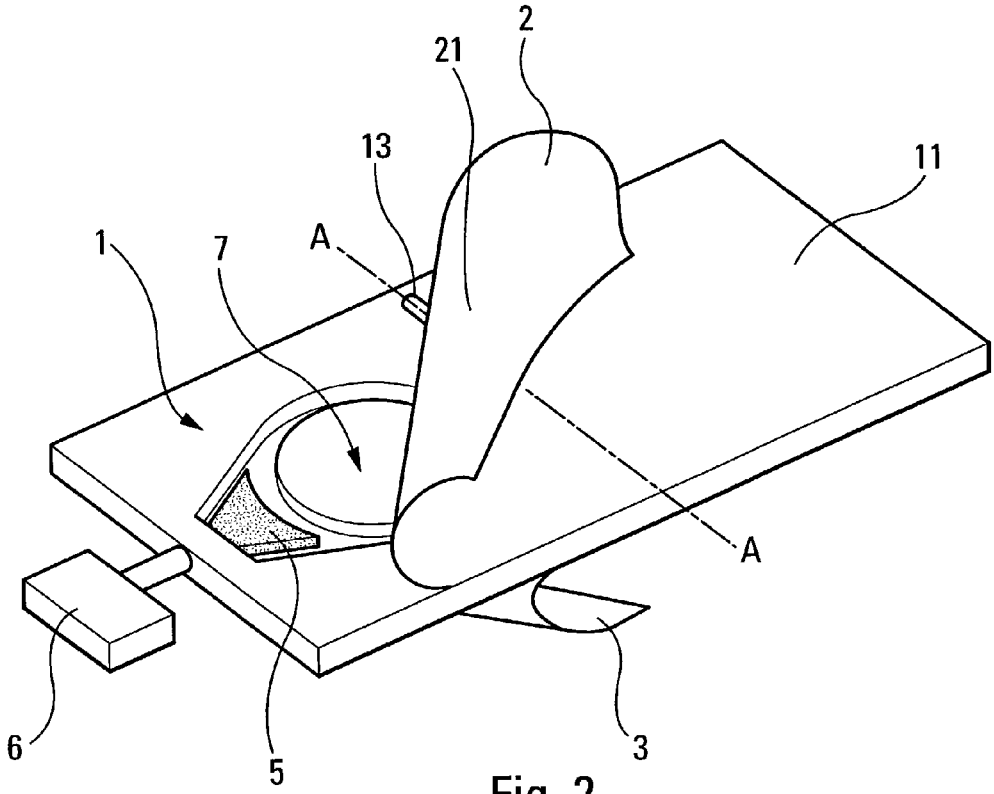
FIG. 2 is a view in perspective of the dispenser of FIG. 1 with the two sheets partially removed.
Figure 3:
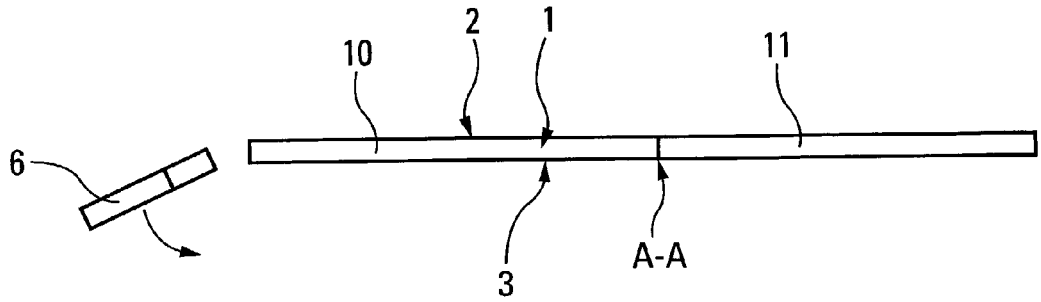
FIG. 3 is a vertical cross-section through the dispenser of FIG. 1 with the removable sealing organ withdrawn.

The reservoir part 10 forms an internal housing or recess 14 which with the two sheets 2 and 3 forms the fluid product reservoir 12. The support part 4 which is received in the housing formed by the substrate 1 seals the recess 14 and maintains the part in porous material 5 so as to extend into the interior of the reservoir 12, as can be seen in FIGS. 1 and 2. Thus, before withdrawing the sealing tab 6, the interior of the reservoir 12 is isolated from the exterior.

For the fixation of the sheets 2 and 3 on the substrate 1, one can for example use a gluing technique, or advantageously heat sealing. Thus sheets 2 and 3 can be fixed or connected to the substrate 1 along lines which can, for example, extend all round the recess 14 and/or all round the external contour of the substrate 1 as shown by the lines of crosses in FIG. 1. Sheets 2 and 3 can extend over the whole of the substrate 1, or only around part of it. For example, sheets 2 and 3 can extend only around the reservoir part 10 of the substrate 1, and leave the actuating part 11 without any coating by sheets.

Figure 4:
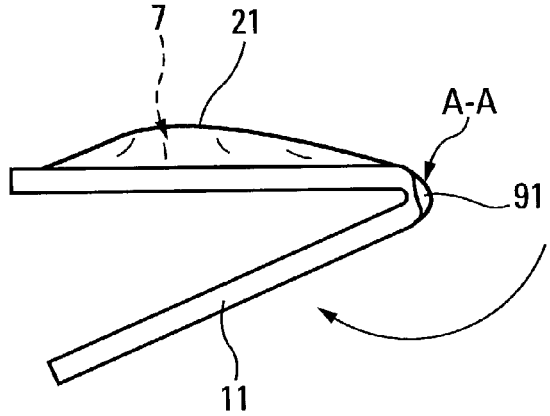
FIG. 4 is a similar view to that of FIG. 3, during arming of the spring means.

According to the invention, the reservoir 12 comprises spring means 7 which are adapted to act on sheet 2 at the level of an actuating wall 21 which is located at the level of the reservoir 12, as seen in FIGS. 2 and 4. The spring means 7 have the function of acting on the actuating wall 21 by separating the sheet 3, which is evidently not possible until after withdrawal of the removable sealing organ 6. When the removable sealing organ 6 is in place and seals the distribution orifice 41, the spring means 7 can also act on the deformable actuating wall 21 but to a very limited measure. Nonetheless this does not prevent conferring the deformable actuating wall 21 with a completely unaesthetic appearance due to irregular deformation.

According to the invention, the spring means 7 extend inside the reservoir 12 under the actuating wall 21. It is not excluded that the actuating wall 21 can be connected or fixed to the spring means 7. Nonetheless, this is not obligatory. The spring means 7 can be an integral part of the substrate 1 as is the case in the embodiment of FIGS. 1 to 5. The spring means 7 can, for example, be under the form of a lobe or a vane extending inside the reservoir 12. In practice, this vane 7 is obtained at the time of the formation of the recess 14 by leaving a central part linked to a recess edge 14 by a bridge 9. The spring means then extend inside the recess 14 with the shape of a peninsular or an isthmus. However, this constitutes only one embodiment, which is that shown in FIGS. 1 to 5. Evidently one can think of other shapes for the spring means. One of the essential characteristics resides in the fact that the spring means extend inside the reservoir 12.

Given that the spring means 7 here are formed directly by the substrate 1, they have the same thickness as the part of the substrate 1 which surrounds them. Without any action, the spring means 7 extend exactly along the same plane as the part of the reservoir 10 surrounding them. Consequently, the spring means 7 do not act upon the deformable wall 21 to deform it: the latter can thus remain without constraint in a suitable aesthetic state.

According to the invention, the spring means 7 co-operate with the arming means which here are represented under the form of the actuating part 11 constituted by the substrate 1. More precisely, the spring lobe or vane communicates with the actuating part 11 through the intermediary of the bridge 9 which is connected to the actuating part 11 between the two elongated windows 13. Consequently, the fold line AA passes between the bridge 9 and the substrate actuating part 11. By looking at FIG. 1, one can even say that the actuating part 11 is only linked to the bridge 9 given that the elongated windows 13 separate practically the whole of the actuating part 11 from the reservoir part 10. The bridge 9 constitutes in practice the only solid and substantially rigid link between the spring means 7 and the actuating part 11 which forms the arming means according to the invention.

Figure 5:
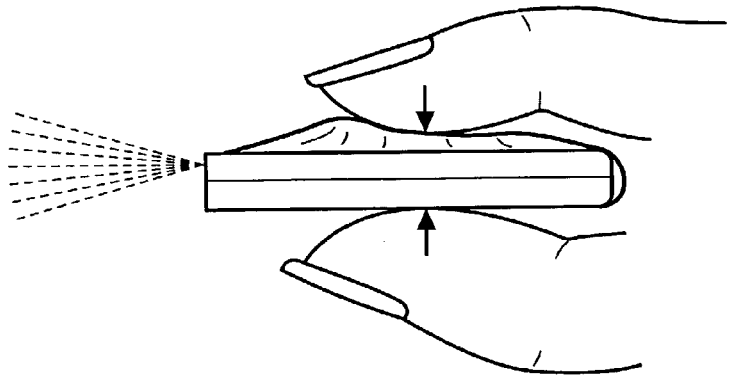
FIG. 5 is a view similar to the preceding FIGS. 3 and 4 showing the dispenser during activation.

Resulting from this, a pivoting of the actuating part 11 along the fold line AA while keeping the reservoir part 10 fixed has the result of pivoting the vane 7 and the bridge 9 in the same direction but beyond the fold line AA because of the relatively rigid link between them, in this case the bridge 9. Nonetheless, the drive of the spring means 7 by the actuating part 11 is very quickly stopped by the sheet 2 which is connected to the substrate 1. The spring means 7 then deform sheet 2 to define the actuating wall 21 up to the state of maximum deformation which corresponds to the maximum volume of the reservoir 12. However, this really only takes place after the withdrawal of the removable sealing organ 6. When the removable sealing organ 6 is still in place, the vane 7 will evidently still be acting against the actuating wall 21, but this will only be slightly deformed. By continuing to pivot the actuating part 11 around the fold line AA, a fold is created between the actuating part 11 and the bridge 9 at the level of the fold line AA between the two elongated windows 13, this place being given the reference number 91 in FIG. 1. Once the fold has been formed, one can continue to pivot the actuating part 11 until it comes into contact with the reservoir part as shown in FIGS. 4 and 5. More precisely, it is the actuating part 11 which comes into contact with the sheet 3 fixed to the reservoir part 10 of the substrate 1. Advantageously, the actuating part 11 has substantially identical or perfectly identical dimensions to those of the reservoir part 10 such that once completely connected, the actuating part 11 comes into place exactly under the reservoir part 10. If the removable sealing organ 6 has been removed beforehand, as in the case of the sequence in FIGS. 3, 4 and 5, the pivoting of the actuating part 11 has the effect of displacing the spring means 7 inside the reservoir 12 in such a way as to push against the actuating wall 21 (FIG. 4). Once the parts 10 and 11 are superposed, it suffices to press on the actuating wall with a finger against the spring means 7 to distribute a measure of fluid product (FIG. 5). The displacement by pivoting the spring means 7 under the effect of pivoting the actuating part 11 is evidently made possible by the fact that air can penetrate into the reservoir 12 through the distribution orifice 41 once this has been freed from the removable sealing organ 6. One can also begin by folding the actuating part 11 on the reservoir part 10 while the removable sealing organ 6 is still in place and seals the distribution orifice 41. In this case, the spring means 7 are applied in the same way against the actuating wall 21 but this is practically prevented from being deformed due to the fact that air cannot penetrate into the reservoir 12. The spring means 7 nonetheless act fully against the actuating wall 21 and it is only at the moment when the removable sealing organ 6 is withdrawn that the spring means 7 can expand slightly and increase the internal volume of the reservoir 12 by deforming the actuating wall 21. In one case as in the other, it can be seen that it is possible to make the spring means operational by actuating the arming means a little or a very little time before utilisation of the dispenser. Consequently, throughout the whole storage time of the dispenser, that is to say from the moment of manufacture to the moment of utilisation, the spring means can remain totally inoperative, which leaves the actuating wall 21 without constraint in a suitable aesthetic state.

The spring means 7 and the arming means 11 can also be considered as a substantially rigid flexible element defining an internal part, in this case the vane 7 and the bridge 9, which extends to the interior of the reservoir 12 and an external part, in this case the actuating part 11 which extends to the exterior of the reservoir. Such an element is foldable at the level of the part of line 91. For example, one can imagine the utilisation of such a foldable element in a dispenser comprising only two flexible sheets connected together, that is to say in the absence of a substrate 1 as is the case in the example used to illustrate the present invention. The flexible element could then be in the shape of a tab or a blade with one part penetrating inside the reservoir and the other part being situated outside the reservoir. By folding the external part on the internal part, automatically a deformation of the actuating wall is created formed by one of the two flexible sheets. This partly suppresses the reservoir 10 of the substrate 1. The support part 4 will then be caught or fixed directly between the two sheets.

Figure 6A:
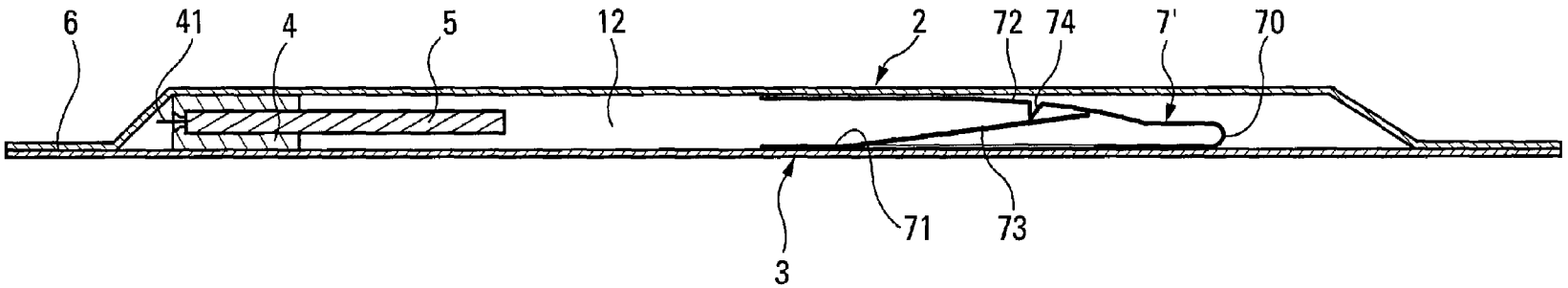
FIGS. 6*a* and 6*b* are transversal cross-sections through a dispenser variant according to the invention.
Figure 6B:
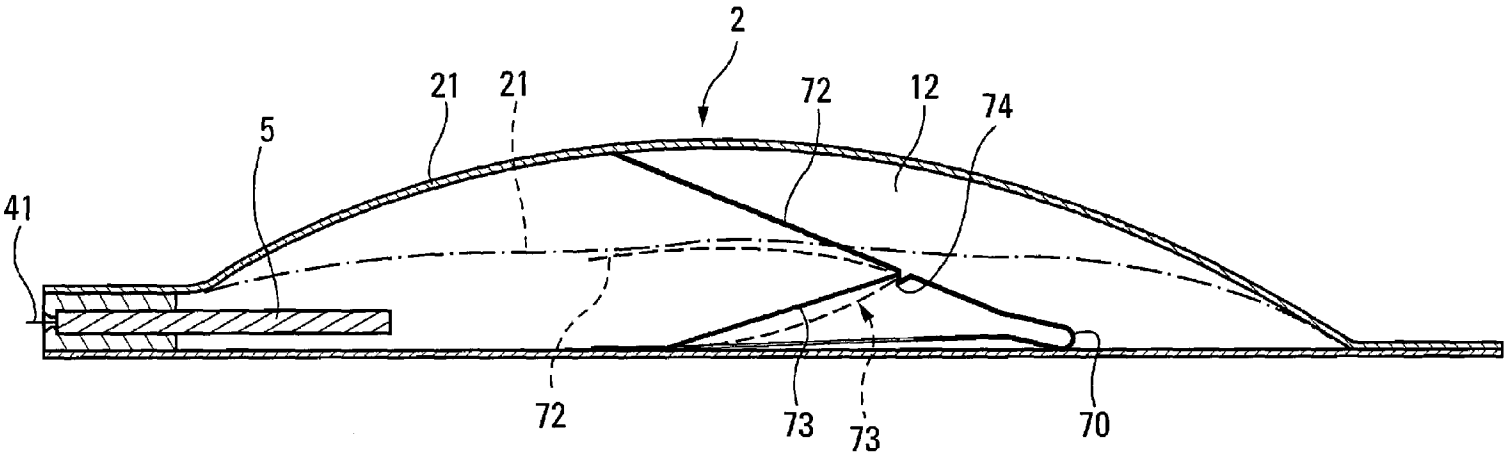

With reference to FIGS. 6*a* and 6*b*, one can see a dispenser comprising other spring means, incorporating the arming means directly. The dispenser is formed from two sheets or from a shell and a sheet or a shell and a plate: in the example shown, it concerns a shell 2 and a sheet 3. As in the preceding example, a support part 4 is fixed between the shell and the sheet and defines the outlet orifice 41 which is sealed by a tearable tab 6. A reservoir 12 is formed between the shell 2 and the sheet 3. This reservoir contains a spring 7' which has the effect of acting on the shell keeping it away from the sheet. This spring 7' comprises two branches 71 and 72 connected together by an elbow 70. The spring also comprises a lug 73 which extends from the branch 71 towards the branch 72. The branch 72 forms a stop 74 against which the free end of the lug can be stopped and remain blocked there.

In FIG. 6*a*, one sees the spring 7' in compressed state with the branches extending substantially parallel. The lug then extends between the branches with its free end located beyond the stop 74, in the direction of the elbow. The lug is constrained elastically and acts weakly in such a way as to separate the two branches. If the spring is freed, which happens automatically when the tab 6 is pulled off and air penetrates into the reservoir, the free end of the lug takes up a position behind the stop. The spring is then armed. By pushing on the spring, which takes place by pressing on the shell 2, the free end of the lug comes up against the stop 74. By continuing to press, the branch 72 and advantageously the lug 73 will flex slightly in an elastic way as shown by the dotted lines in FIG. 6*b*.

This spring 7' is slightly stiff in the position in FIG. 6*a* and much stiffer in the position in FIG. 6*b*. The lug serves as a means for arming the spring. But in this embodiment, the arming means are located inside the reservoir and advantageously integrated with the spring.

Figure 7:
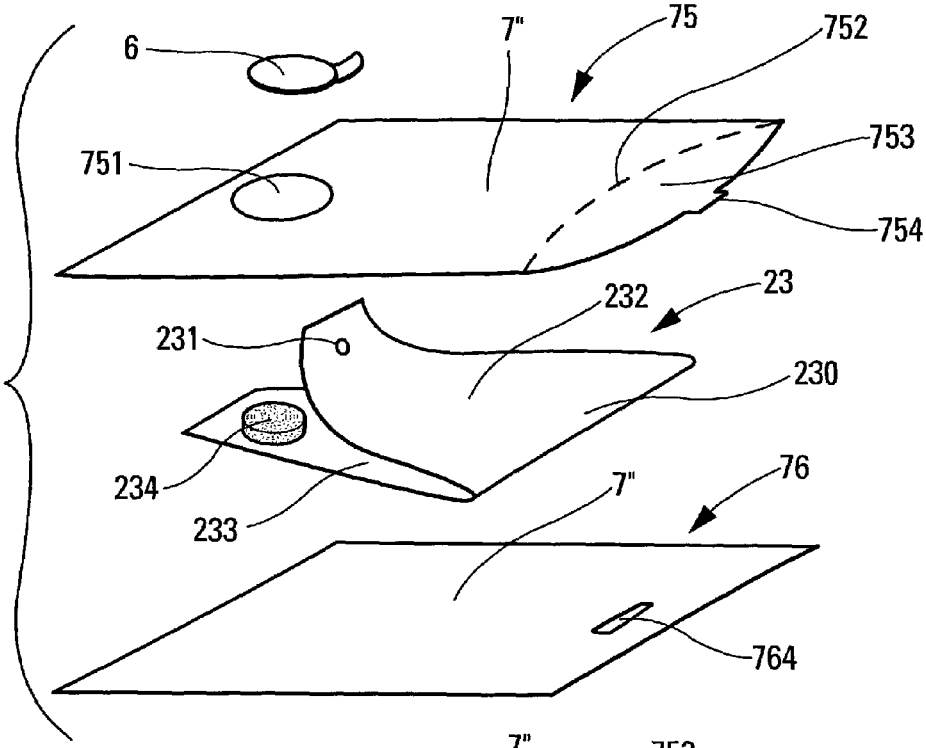
FIG. 7 is an exploded perspective view of a dispenser according to another embodiment of the invention.
Figure 8:
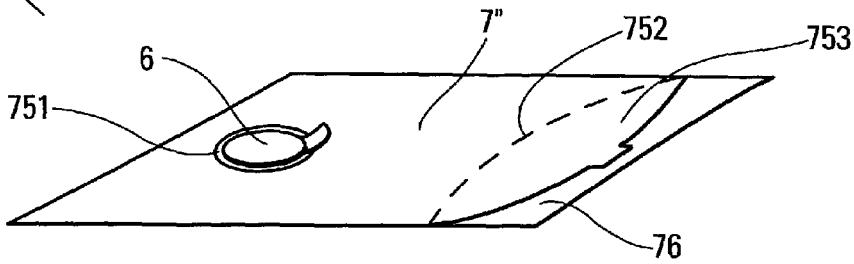
FIG. 8 is a view of the dispenser in FIG. 7 in a mounted condition.
Figure 9:
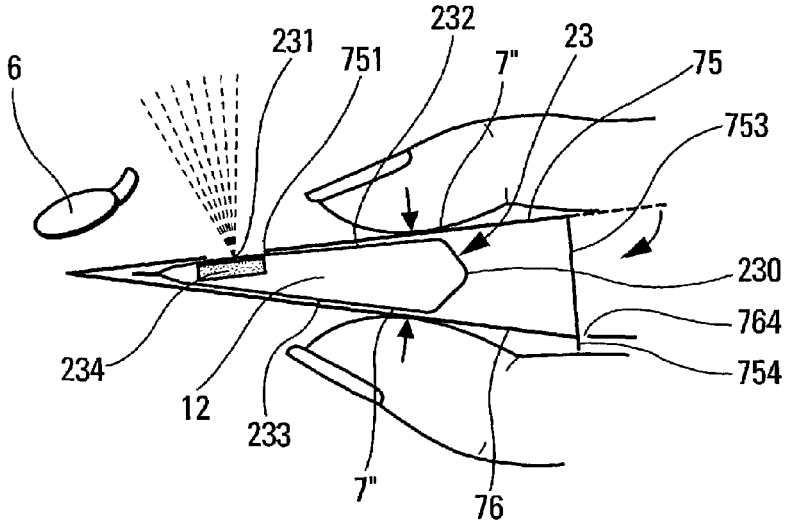
FIG. 9 is a vertical longitudinal cross-sectional view through the dispenser in FIG. 8 during an actuating phase.

With reference to FIGS. 7, 8 and 9, a third embodiment of the invention is shown. This dispenser comprises a pouch of liquid or pulverulent fluid product 23, made here from a flexible deformable sheet folded back on itself in such a way as to define a lower sheet 233 and an upper sheet 232. Sheets 232 and 233 are joined at the level of a linkage fold 230. A sheet 231 is pierced by an outlet or dispensing orifice 231. The two sheets 232 and 233 are fixed together in a sealed manner around their free periphery. Advantageously, the sealed fixation of the two sheets can be produced by heat sealing. Thus, between the two sheets, a reservoir is defined for fluid product 12 of variable volume given that the sheets 232 and 233 are made out of a deformable flexible material. Each sheet forms an actuating wall. Advantageously, the reservoir 12 comprises a part in porous material 234 able to absorb or be impregnated with liquid or pulverulent fluid product. Preferably, the part 234 is set in direct contact with the dispensing orifice 231. For example, the part 234 can be fixed on the sheet 233 or the sheet 232.

The dispenser also comprises spring and arming means shown here under the form of an upper plate 75 and a lower plate 76. The two plates 75 and 76 are shown separately here, but it is also possible to use a piece of a single plate joined by a linkage fold, as in the case for the sheets constituting the pouch 23. The upper plate 75 defines a substantially central zone 7" to act as spring return means, as explained below. The plate 75 is also formed with an opening 751 inside which a removable sealing organ 6 can be lodged. Furthermore, the plate 75 is formed with a fold line 752 defining an end flap 753, which can thus be articulated by pivoting around this line 752. This flap 753 will serve as arming means under the form of spacer means, as will be explained below. The flap 753 is further provided with a small blocking tab 754 whose function will be explained below.

As for the lower plate 76, it can also define spring return means 7" at the level of its central part, for example. Furthermore, the lower plate 76 is formed with a window 764 intended to receive the blocking tab 754 of the upper plate 75.

Plates 75 and 76 are intended to be fixed together around their periphery, apart at the region of the flap 753 corresponding to the window 764. Advantageously, the two plates can thus be heat sealed on three of their sides, forming a U-shape. Thus one obtains a sort of envelope sealed on three sides and open on one side where the articulated flap 753 is formed. The flexible pouch 23 is set between the two plates 75 and 76 inside the envelope they form together. Advantageously, the dispensing orifice 231 is placed centrally at the level of the opening 751. Thus, the removable sealing organ can be set in the opening 751 closing the dispensing orifice 231 in a sealed manner. Advantageously, the pouch 23 can be fixed inside the envelope constituted by the two plates.

When the flap 753 extends in the same plane as the remainder of the plate 75, as shown in FIGS. 7 and 8, the plate 75 extends substantially parallel to the plate 76, with the flexible pouch 23 inserted between them. Advantageously, the flexible pouch 23 only contains a very small amount of fluid product, so that it has an especially flat shape. Therefore, when set between the two plates 75 and 76, it only creates a slight extra thickness, and thus the two plates 75 and 76 seem to be superposed with almost nothing between them. This is shown in FIG. 8. The cumulated thickness of the dispenser can be of the order of 2 to 3 mm. It corresponds essentially to the addition of the thicknesses of the two plates 75 and 76, the two sheets 232 and 233 and the thickness of the part in porous material 234. The dispenser is then in the ready state for transport and storage. The sheets 232 and 233 of the flexible pouch 23, forming part of the actuating walls of the flexible pouch 23, are not subject to any stress. In the same way, the plates 75 and 76 are not subject to any stress.

Advantageously, sheet 232 is fixed to the plate 75 and the sheet 233 is advantageously fixed to the plate 76, except at the level of and nearby the fold line 230.

In order to arm the dispenser, it is sufficient to pivot the flap 753 around the articulation line 752 in the direction of the lower plate 76, as shown by the small arrow and the dotted lines in FIG. 9. Advantageously, the fold line 752 is curved in the shape of, for example, an arc of a circle. Symmetrically, the edge of the flap where the tab is formed, may also be formed in an curved manner. Thus, when the flap 753 pivots downwards in the direction of the lower plate 76, the plates 75 take on a curvature corresponding to the fold line 752 and the bearing edge. The flap 753 is articulated by pivoting until its free edge bears against the plate 76 and its little blocking tab 754 lodges inside the window 764 formed in the lower plate 76. This is shown in FIG. 9. The flap 753 then extends substantially perpendicular to both the plate 75 and the plate 76. When the tab 754 is inserted in the window 764, the flap 753 is blocked in position. For example, the flap 753 can be made in a rigid manner. It thus constitutes spacer means enabling the two plates 75 and 76 to be maintained separate from each other.

Given that the sheet 232 is fixed to the plate 75 and the sheet 233 to the plate 76, the spacing between the two plates resulting from interposing the spacer flap 753 also has the effect of keeping the two sheets 232 and 233 apart from each other. The internal volume of the reservoir 12 is thus increased by entry of air through the dispensing orifice 231, and advantageously through the part in porous material 234. It is evidently understood that this is only possible after withdrawing the removable sealing organ 6. In fact, it is practically impossible, without destroying the dispenser, to turn back the flap 753 to position it as shown in FIG. 9 without previously removing the sealing organ 6. The spacing between the plates 75 and 76 is only possible if air can penetrate inside the reservoir 12. According to the invention, the plates 75 and 76, particularly at the level where they form the spring means 7", are made out of an elastically deformable material which provides them with this return elasticity property. Therefore, once the dispenser is in the configuration shown in FIG. 9, it can be activated by pressing on the plate 75 at the level 7" with one finger and by keeping the other plate 76 at the level 7" using another finger. In this embodiment each one of the plates 75 and 76 forms a spring return means. However, one can envisage an embodiment in which only a single one of the plates forms elastic return means, while the other plate can be perfectly rigid and act as a reaction surface. In this case, in the embodiment of FIG. 9, the two plates 75 and 76 can be deformed at the level 7", with the result of displacing the sheets 232 and 233, bringing them closer together by deforming the fold part 230. The result is to put the reservoir 12 under pressure and thus to expel a mixture of air and fluid product through the dispensing orifice. Preferably, the fluid product is impregnated in the part of porous material 234, and the air contained in the remainder of the reservoir passes through the part in porous material to bring the fluid product with it.

Thus, it can be noted that the spacer flap 753 forms arming means making it possible to have the plates 75 and 76 in a spaced configuration such that they form spring means associated with the actuating walls 232 and 233 of the flexible pouch 23.

The spring and arming means are shown here in the form of an envelope surrounding a flexible pouch 23. Other forms of embodiments can also be envisaged, in the form of two narrow blades or strips, with one of them comprising an arming spacer flap. Then the flexible pouch 23 would be set between these two strips.

It can also be noted that the arming means, that is the flap 753, are made in integral fashion with the plate 75. These means could also be made in integral fashion with the plate 76. It would also be possible to place the flap on one of the two plates.

In this embodiment, the flap 753 is rigid, and at least one of the two plates at the level 7" is made in an elastically deformable manner. It is also possible to envisage an embodiment in which the flap 753 is elastically deformable by flexion, whereas the two plates 75 and 76 are substantially non-deformable or rigid. In this case, the arming means also form spring means. The flap and the plates may also be deformable.

Figure 10:
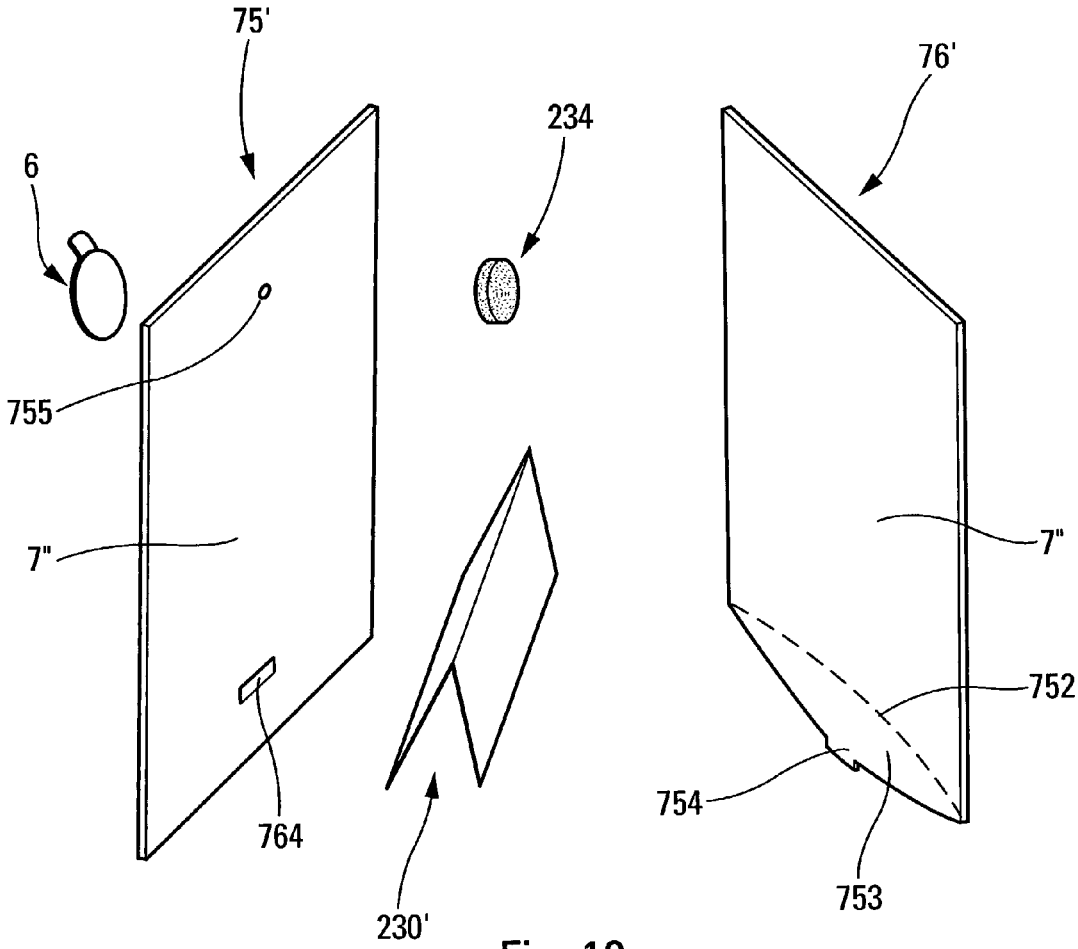
FIG. 10 is a side exploded perspective view of an alternative embodiment of the dispenser in FIGS. 7 to 9.
Figure 11:
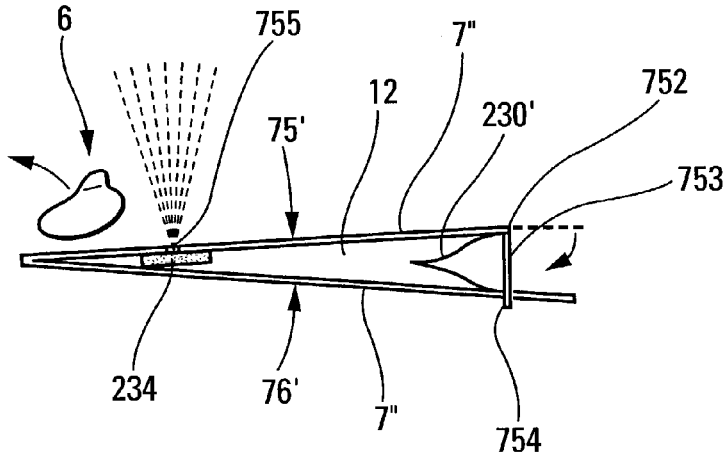
FIG. 11 is a vertical cross-sectional view through the dispenser of FIG. 10 in a mounted condition during an actuating phase.

FIGS. 10 and 11 represent another embodiment of the dispenser of FIGS. 7 to 9. It differs from the preceding embodiment in that it does not comprise a separate flexible pouch containing the fluid product. This dispenser comprises a front plate 75' and a rear plate 76'. The plate 75' forms a dispensing orifice 755 as well as a window 764. The plate 76' forms a folding and pivoting line 752 defining an arming spacer flap 753. The two plates 75' and 76' each form a spring zone 7". The sheets 75' and 76' are fixed together, advantageously by heat sealing, around their periphery, except for the side of the flap 753 and the window 764. The fixation must be tightly sealed. In fact, in this embodiment, the sheets 75' and 76' together form the fluid product reservoir 12. They can also contain a part in porous material 234, advantageously fixed to the sheet 75' or the sheet 76'. In order to complete the reservoir at the level of the flap 753, an articulation wall 230' is provided, fixed in sealed manner around the whole of its periphery, both to the plate 75' and the plate 76'. The reservoir is therefore defined by the two plates and the articulation wall 230'

The arming of this dispenser takes place in the same way as for the preceding embodiment. The flap 753 can be turned back towards the plate 76' so as to insert the tab 754 in the window 764. Thus, the two plates 75' and 76' are separated from each other by increasing the internal volume of the reservoir 12. Evidently this is only possible after withdrawing the removable sealing organ 6. It then suffices to press on the plates 75' and 76' to bring them closer together and thus reduce the internal volume of the reservoir 12 to expel the fluid product through the part in porous material 234 and the dispensing orifice 755.

The plates 75' and 76' are elastically deformable here at the level of their zones 7", but it can also be envisaged that they can be perfectly rigid and that the flap 753 can be made in an elastically deformable manner.

Figure 12:
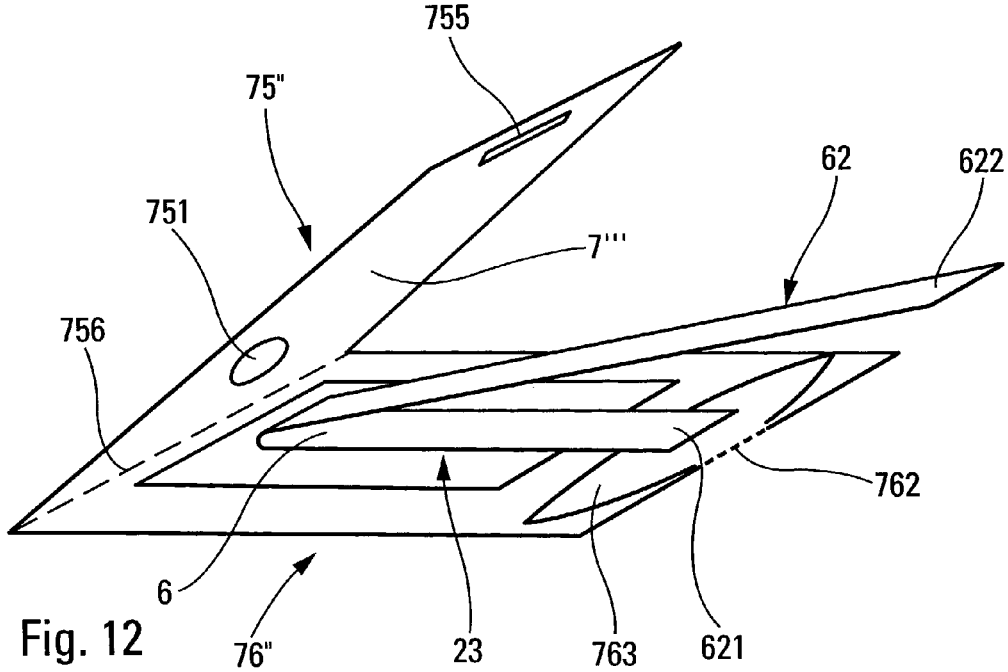
FIG. 12 is yet another alternative embodiment of the dispenser in FIGS. 7 to 9 during an actuating phase.
Figure 13A:
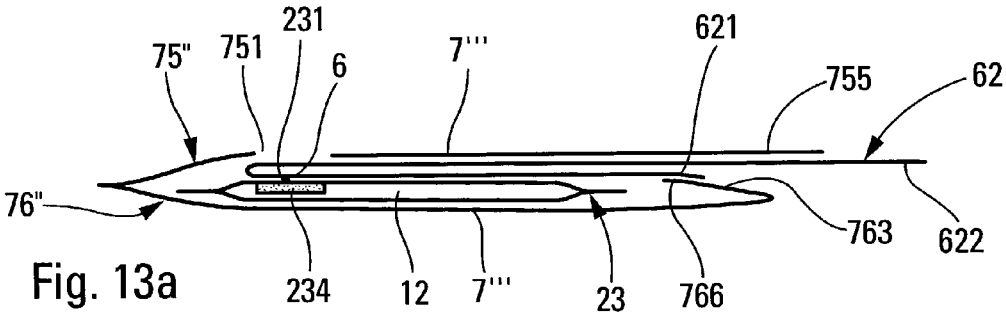
FIGS. 13*a*, 13*b* and 13*c* are cross-sectional views through the dispenser in FIG. 12, respectively before use, during arming and fully armed.
Figure 13B:
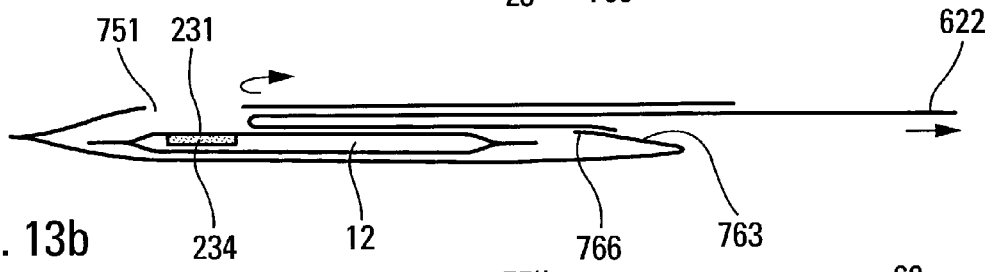
Figure 13C:
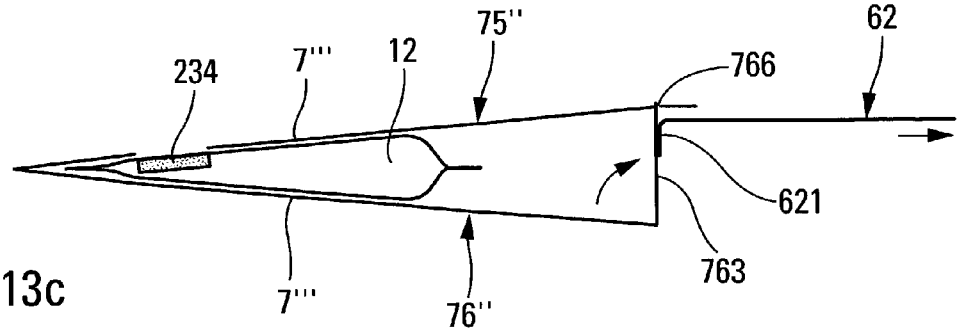

FIGS. 12, 13*a*, 13*b*, and 13*c* refer to and explain an alternative embodiment for producing the dispenser of FIGS. 7 to 11. This dispenser also comprises two plates 75" and 76" linked together at the level of the linking fold 756. The two plates 75" and 76" can thus be made in integral fashion. The plate 75" comprises an opening 751 and a window 755. The plate 76" forms a flap 763 connected to the remainder of the plate along an articulation line 762. In its initial position, the flap 763 is folded back and flattened against the plate 76", as can be seen in FIG. 12. A flexible pouch 23 is provided with a dispensing orifice 231 and advantageously with a part in porous material 234. The pouch 23 is set between the two plates. The dispensing orifice 231 is set at the level of the opening 751. According to this embodiment, an opening strip 62, operating as actuating means, comprises an extremity 621 connected to the flap 763 and an opposite traction extremity 622. Between these two extremities, the strip comes to the level of the distribution orifice 231 to form a removable sealing organ 6. The strip 62 therefore extends from the flap 763 to the dispensing orifice 231; after that the strip forms a fold so that it extends over the first part of the strip. This can be seen in FIG. 12. Once the plate 75" is bent back and fixed on the plate 76", only the traction extremity 622 extends beyond the envelope constituted by the plates. Evidently, the actuating walls of the pouch 23 are fixed respectively to the plates 75" and 76". Before use, the dispenser is as shown in FIG. 13*a*. By pulling the strip, seizing it by the traction end 622, one begins by taking off the removable sealing organ 6 from the dispensing orifice 231. This is shown in FIG. 13*b*. By continuing to pull the strip 62 one makes the flap 763 pivot around the line 762 until its tab 766 is inserted in the window 755. Supplementary traction, for example, can act to separate the strip 62 from the flap 763. One thus returns to a dispenser identical to that of FIG. 9.

This actuating strip 62 therefore fulfils a double function, both that of taking off the removable sealing organ and that of arming.

In the three main embodiments, namely corresponding to FIGS. 1 to 5, FIGS. 6*a* and 6*b*, and FIGS. 7 to 13*c*, arming means allow initially inactivated spring means to be moved in an biasing condition wherein it elastically drive at least one actuating wall of a reservoir in a maximum volume state. Theses three embodiments may be of course protected separately. Some feature may even be combined.

What is claimed is:

1. A fluid product dispenser comprising:

a reservoir of fluid product defining an actuating wall able to be moved;

a distribution orifice; and spring means adapted to act on the actuating wall to produce a state of maximum volume of the reservoir, the spring means co-operating with arming means structured to bring the spring means to bias the actuating wall starting from an initial state in which the spring means do not bias the actuating wall; and wherein the spring means and the arming means are integrally formed.

2. Dispenser according to claim 1, in which the spring means and the arming means are connected by a deformable zone.

3. Dispenser according to claim 2, in which the deformable zone is able to form a fold line.

4. Dispenser according to claim 1, in which the spring means are integrated into the deformable wall.

5. Dispenser according to claim 1, in which the distribution orifice is sealed by a removable sealing organ.

6. Dispenser according to claim 5, in which the reservoir contains almost only the fluid product before the removable sealing organ is withdrawn.

7. The dispenser according to claim 1, in which the arming means is located outside the reservoir.

8. The dispenser according to claim 1, in which the arming means comprises a pivoting arming organ.

9. A fluid product dispenser comprising:

a reservoir of fluid product defining an actuating wall able to be moved;

a distribution orifice; and spring means adapted to act on the actuating wall to produce a state of maximum volume of the reservoir, the spring means co-operating with arming means structured to bring the spring means to bias the actuating wall starting from an initial state in which the spring means do not bias the actuating wall; and wherein the spring means comprise a flexible front plate and a rear plate, the reservoir being situated between the front and back plates, the arming means comprising spacer means able to be positioned between the front plate and the rear plate to separate them from each other, at least locally, the flexible front plate thus being elastically deformable when the rear plate approaches so as to squash the reservoir between them.

10. Dispenser according to claim 9, in which the spacer means are produced in integral manner by the front plate or the rear plate.

11. Dispenser according to claim 9, in which the spacer means are movable selectively between an inoperative position in which the two plates extend substantially parallel corresponding to a minimum volume state of the reservoir and an operative position in which the two plates are separated from each other.

12. Dispenser according to claim 9, in which the spacer means comprise an articulated flap integral with the front plate or back plate respectively at the level of an articulation line and defining a bearing edge intended to come into bearing contact against the rear or front plate respectively, said flap being substantially non-deformable.

13. Dispenser according to claim 9, in which the plates are fixed together around their peripheries, apart from the level of an open side where the spacer means are located.

14. Dispenser according to claim 9, in which the reservoir is formed by a flexible pouch set between the front and rear plates.

15. Dispenser according to claim 9, in which the reservoir is formed by the front and rear plates.

16. Dispenser according to claim 9, in which the dispensing orifice is closed by a removable sealing organ, common actuating means being provided for consecutively removing the removable sealing organ and positioning the spacer means between the two plates.

17. Dispenser according to claim 16, in which the common actuating means comprise a strip defining a first extremity connected to the spacer means and a second traction extremity, the removable sealing organ being integral with the strip, such that traction on the strip at the level of the second traction extremity produces, firstly, removal of the removable sealing organ and, secondly, the positioning of the spacer means between the two plates.

18. A fluid product dispenser comprising:

a reservoir of fluid product defining an actuating wall able to be moved;

a distribution orifice; and spring means adapted to act on the actuating wall to produce a state of maximum volume of the reservoir, the spring means co-operating with arming means structured to bring the spring means to bias the actuating wall starting from an initial state in which the spring means do not bias the actuating wall; and further comprising a front plate and a rear plate, the reservoir being located between the front and rear plates, the arming means comprising spacer means which can be positioned between the front plate and the rear plate, to separate them from each other, at least locally, the spacer means being elastically deformable so as to allow the front and rear plates to approach each other and thus squash the reservoir located between them.

19. A fluid product dispenser comprising:

a reservoir of fluid product defining an actuating wall able to be moved;

a distribution orifice; and spring means adapted to act on the actuating wall to produce a state of maximum volume of the reservoir, the spring means co-operating with arming means structured to bring the spring means to bias the actuating wall starting from an initial state in which the spring means do not bias the actuating wall; and wherein the arming means form the spring means.

20. A fluid product dispenser comprising:

a reservoir of fluid product, the reservoir comprising a moveable actuating wall, a distribution orifice, a spring, and an arming device that arms the spring;

wherein when the spring is unarmed within the dispenser, the spring does not bias the moveable actuating wall, and when the spring is subsequently armed within the dispenser by the arming device, the spring biases the actuating wall and increases the volume of the reservoir; and wherein the distribution orifice communicates the interior of the reservoir with the exterior of the dispenser, and further comprising a sealing device for sealing off the distribution orifice, the sealing device separate from the arming device.

* * * * *